United States Patent [19]

Hovey

[11] Patent Number: 4,530,163

[45] Date of Patent: Jul. 23, 1985

[54] SIGHTING DEVICE

[76] Inventor: Elmer L. Hovey, Box 30, RFD #1, Rte. 23, Franklin, N.J. 07416

[21] Appl. No.: 555,531

[22] Filed: Nov. 28, 1983

[51] Int. Cl.[3] ..... F41G 1/00; F41G 1/46

[52] U.S. Cl. ..... 33/265

[58] Field of Search ..... 33/265

[56] References Cited

U.S. PATENT DOCUMENTS

| | | | |
|---|---|---|---|
| 2,959,860 | 11/1960 | Kowalcyk | 33/265 |
| 2,982,026 | 5/1961 | Peterson | 33/265 |
| 3,058,221 | 10/1962 | McNeel | 33/265 |
| 3,266,149 | 8/1966 | Powell | 33/265 |
| 3,271,863 | 9/1966 | Harrington | 33/265 |

*Primary Examiner*—Harry N. Haroian

*Attorney, Agent, or Firm*—Bernard J. Murphy

[57] ABSTRACT

The device, according to the embodiment shown, comprises a pair of plates, coupled together, to define a base and a platform. Right-angular portions of the plates are adjustably fastened together, at common ends of the plates, and the opposite, common ends are adjustably fastened together by lengthy bolts which serve as standoffs. By moving the right-angular portions of the plates into and out of proximity to each other, they can be disposed in parallel, or set at acute angles relative to each other, whereby a desired azimuth sighting can be achieved. The base has bolt holes formed therein for fastening of the device to either the right-hand or left-hand side of a bow, to accommodate right-handed or left-handed shooters or archers. The platform pivotably supports an elongate strip, and the latter can be slued through desired angles, relative to the platform, whereby a desired elevation sighting can be achieved. Adjacent opposite ends of the strip are tapped holes which receive a tapered pin and an eye-bolt in either usage disposition or stowage disposition. Further, the strip has trackways on the lateral edges thereof slidably to receive a boresight, telescope, or the like.

10 Claims, 7 Drawing Figures

SIGHTING DEVICE

This invention pertains to sighting aids and devices, such as are used in target shooting and hunting, and in particular to sighting devices, for bows, usable by right-handed or left-handed shooters or archers, which provide for both azimuth and elevation adjustment.

Sighting devices for bows, of the aforesaid type to which the invention pertains, are known in the prior art. Typical thereof is the Archery Sight, U.S. Pat. No. 3,84,904, issued Nov. 15, 1966, to Douglas B. Rade. The patentee's Sight accommodates for azimuth and elevation correction or adjustment, and is usable on bows for left-handed or right-handed shooters or archers. It is, however, a rather complex structure which, necessarily, involves expensive manufacture and, resultantly, high cost. What has been long sought is an inexpensive, simple, and efficient sighting device for bows which will accommodate both azimuth and elevational adjustment, and can be employed by either left-handed or right-handed shooters or archers.

It is an object of this invention to set forth just such an inexpensive, simple and efficient sighting device. Particularly it is an object of this invention to disclose a sighting device, for a bow, comprising first means defining a base; said base having means for coupling thereof replaceably to a bow; second means defining a platform; third means, joined to said base and platform, supporting said platform in spaced-apart adjacency to said base; fourth means for removably receiving sighting means thereon; and means pivotably coupling said fourth means to said platform, whereby elevation sighting adjustments may be made; and wherein said third means comprises means for selectively disposing said platform (a) in parallelism with said base, and (b) in acute angles relative to said base, whereby azimuth sighting adjustments may be made.

Further objects of this invention, as well as the novel features thereof, will become more apparent by reference to the following description, taken in conjunction with the accompanying figures, in which.

Figure 1:
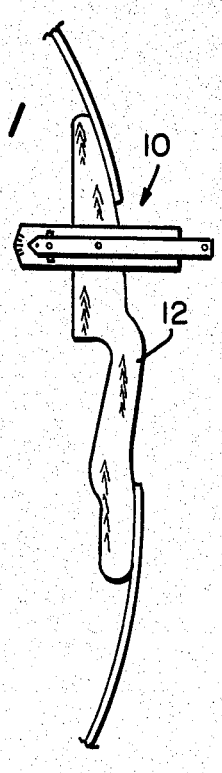
FIG. 1 is a side elevational view of a portion of a bow showing the novel sighting device, according to an embodiment thereof, fixed thereto.
Figure 4:
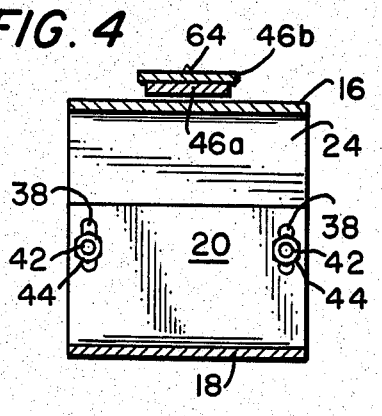
FIG. 4 is a cross-sectional view taken along section 4—4 of FIG. 2.
Figure 5:
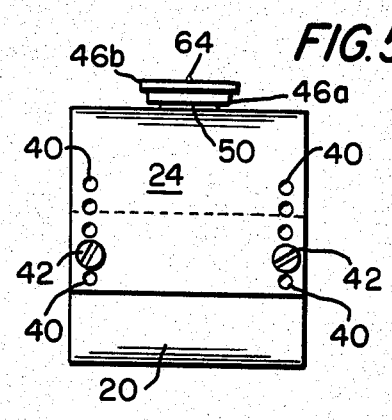
FIG. 5 is an end view, taken from the left-hand side of FIG. 2, of the right-angular portions of the base and plate.
Figure 7:
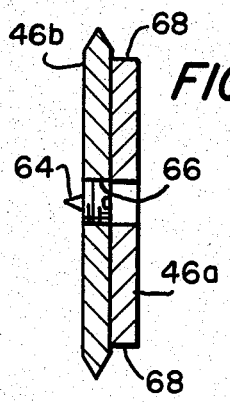
FIG. 7 is a cross-sectional view taken along section 7—7 of FIG. 3.

As shown in the figures, an embodiment of my sighting device 10 is mountable to a bow 12, for a right-handed shooter or archer, as shown, but it is also mountable to the bow 12, on the opposite, hidden side thereof, for a left-handed shooter or archer.

The device 10 comprises a base 14 and a platform 16, the former for fixing thereof to the side of a bow—such as bow 12, and the latter for removably receiving sighting means thereon. The base 14 comprises an elongate plate 18 having a principal portion thereof subsisting in a given plane, and defining the base 14, and having a minor portion thereof, integral with the principal portion, which extends normal to the given plane, such minor portion 20 serving as a part of the means for supporting the platform 16 upon the base 14.

The platform 16 is also defined from another elongate plate 22, the principal portion of the latter also subsisting in a given plane and forming the platform, and having an integral, minor portion 24, extending normal to such plane, and cooperating with portion 20 to define means for supporting the platform 16 upon the base.

The base 18 has a pattern of bolt holes 26 formed therein by means of which the base can be fastened to the side of a bow; commonly bows have metal plates or bosses, with tapped holes, in the sides thereof, to receive fasteners for sighting devices. Further, the base 18 has a pair of bolt holes 28 formed in one end thereof to receive a pair of lengthy bolts 30 which serve as standoffs. Bolts 30 are secured to the platform 16 by nuts 32, and nuts 34 and 36, threadedly engaged with the bolts, on opposite sides of the base 18, accommodate for an adjustment of the proximity of the base 18 to the platform 16.

Figure 2:
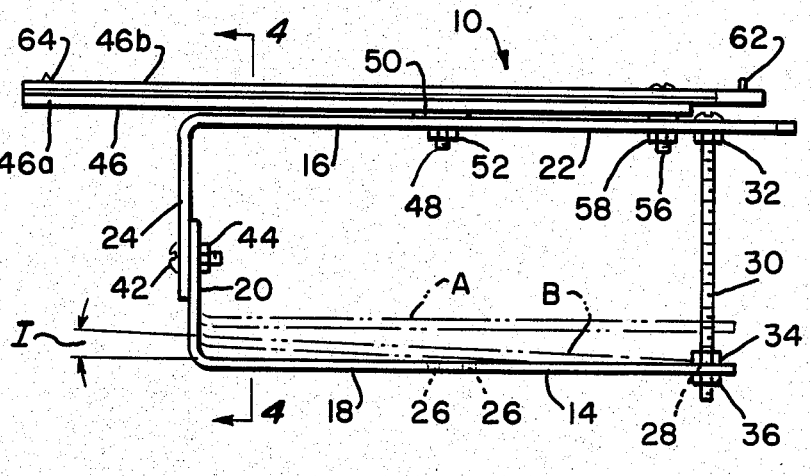
FIG. 2 is a side elevational view of the sighting device of FIG. 1, the same being shown greatly enlarged over the scale of FIG. 1.

Portion 20 of the plate 18 has a pair of parallel slots 38 formed therein, and the latter are in registry with a pair of series of holes 40 formed through portion 24 of plate 22. Bolts 42 and nuts 44 are used in selected ones of the holes 40 to cooperate with the bolts 30 and nuts 34 and 36 to adjust the proximity between the base 18 and platform 16, and further they are used to selectively dispose the platform 16 in a desired angle—such as angle "I" (FIG. 2)—to adjust the azimuth sighting. With such an adjustment being made, the base 18 will be in disposition "B" (FIG. 2) and consequently, and relatively, the platform will be aligned along angle "I". When bolts 42 and nuts 44, together with nuts 34 and 36 on bolts 30, are all adjusted to move the base 18 and the platform 16 closer together, for instance, the relative positioning of the base 18 will be as shown in disposition "A". Usually, a user of the device 10 will make this parallel adjustment but once, to accommodate the device to his sighting eye (left or right), and thereafter will not loosen the nuts 34 and 36 again. Subsequently, for zeroing-in on given targets at given distances, he will opt to make azimuth adjustments by means of the bolts 42, nuts 44, holes 40 and slots 38.

Figure 6:
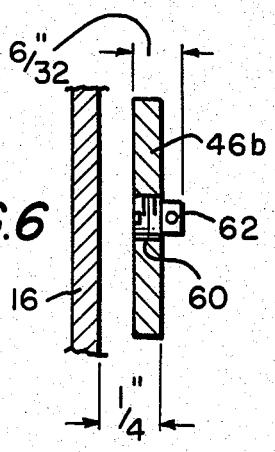
FIG. 6 is a cross-sectional view taken along section 6—6 of FIG. 3.

An elongate strip 46 is mounted atop the platform 16. The strip 46 is pivotably mounted thereto by means of a bolt 48, washer 50 and nut 52. Additionally, the platform 16 has an arcuate slot 54 formed therein which serves as a keyway for a keying bolt 56 extending from adjacent the leading end of the strip 46. A nut 58 secures the bolt 56 in engagement with the slot 54. The strip 46 is formed of two, surmounting pieces **46*a* and 46*b*. At the leading end of the strip 46, the underlying piece 46*a* is foreshortened and, as can be seen in FIG. 6, is spaced apart from the platform approximately one-eighth of an inch (in this embodiment of the invention). The end of the strip 46 which is pointed, and defines its trailing end, and has a small tapped hole 60 formed therein. Threaded into hole 60 is an eye-bolt 62 which, in this exemplary embodiment, is a short, threaded dowel with a transverse hole formed therein. Dowel 62 has a drive slot in the threaded end thereof to receive a screwdriver by means of which it can be selectively removed and inserted. The priorly mentioned spacing (one-eighth of an inch) plus the thickness of piece 46***b* totals approximately one-quarter of an inch. Now, the overall length of the eye-bolt/dowel 62 is slightly less than that, i.e., such overall length is approximately six thirty-seconds of an inch. These dimensions are of significance, as the ensuing text will evidence. As shown, the dowel 62 projects from the platform to be used for sighting or aiming purposes. Similarly, a pin 64, which has an enlarged, threaded shank and a small, taper-pointed end, is received in a threaded hole 66 in the opposite, or leading end of the strip 46. Pin 64 also has a drive slot in its threaded end to accommodate it removal and installation. It will be appreciated that a user of the device 10 can sight or aim by viewing the taper-pointed end of the pin 64 through the transverse hole in the dowel 62. However, both the dowel 62 and the pin 64 can be disposed in stowage on the strip 46.

Figure 3:
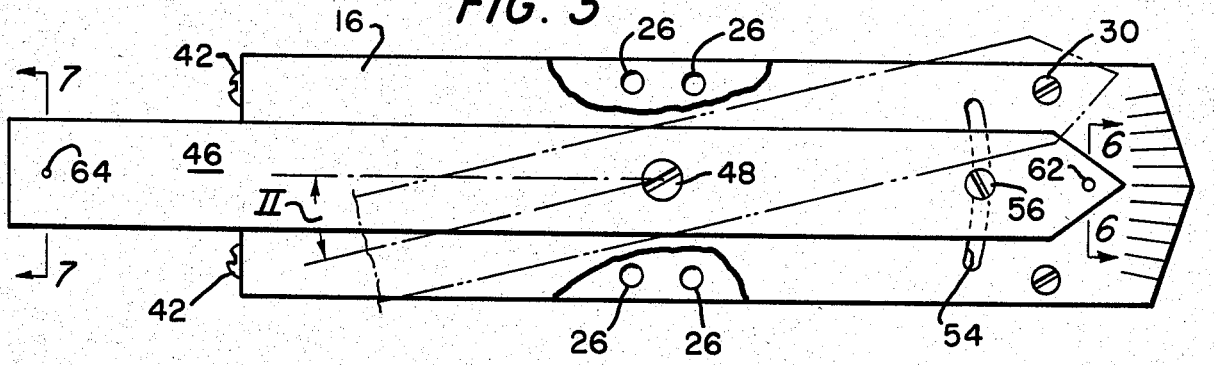
FIG. 3 is a plan view of the sighting device of FIGS. 1 and 2, with portions of the platform, at the sides thereof, being cut away only to show the base mounting holes.

By sluing the strip 46 to an angle, such as angle "II" shown in FIG. 3, the drive slot of the dowel 62 can be accessed. Then, by using a screw-driver, the dowel can be removed from the hole 60, turned end-for-end, and re-inserted into the hole 60—now, with the apertured end thereof directed toward the platform 16. In such a disposition, the dowel 62 shall be in stowage, and due to its short length, will not interfere with the pivotal sluing of the strip 46, and will leave the outermost surface of the trailing end of piece 46*b* clear and unobstructed. In a like manner, the pin 64 can be withdrawn from pieces 46*a* and 46*b*, turned end-for-end, and stowed, like dowel 62, under the strip 46. There is a purpose for this stowage-accommodation of the dowel 62 and pin 64.

For more accurate sighting, users of the device 10 may choose to employ a telescope, or an electronic sighting component, such as an Aimpoint, Electronic Mark III, a commercial product of Sweden. Such components commonly have grooved slides and/or clamps for mating thereof to plates or bosses on the sides of firearms or bows. To accommodate such components, the strip 46 provides trackways 68 on the lateral sides thereof. Piece 46*a* is narrower than piece 46*b;* the latter overhangs the former, along the full length of piece 46*a*. Such overhangs define shoulders which serve as the trackways 68 for the aforesaid more accurate sighting components. Too, with the pin 62 and dowel 64 in stowed positions, the exposed surface of the strip is free and unobstructed, slidably to accommodate such sighting components.

While I have described my invention in connection with a specific embodiment thereof, it is to be clearly understood that this is done only by way of example, and not as a limitation to the scope of my invention, as set forth in the objects thereof and in the appended claims.

I claim:

1. A sighting device, for a bow, comprising:

first means defining a base;

said base having means for coupling thereof replaceably to a bow;

second means defining a platform;

third means, joined to said base and platform, supporting said platform in spaced-apart adjacency to said base;

fourth means for removably receiving sighting means thereon; and means pivotably coupling said fourth means to said platform, whereby elevation sighting adjustments may be made; and wherein said third means comprises means for selectively disposing said platform (a) in parallelism with said base, and (b) in acute angles relative to said base, whereby azimuth adjustments may be made;

said first means comprises a first elongate plate;

said plate having a principal portion thereof subsisting in a given plane, and a minor portion thereof, at an end thereof, extending normal to said given plane;

said principal portion of said plate defining said base;

said minor portion of said plate defining part of said third means;

said second means comprises a second elongate plate;

said second plate having a principal portion thereof subsisting in a given plane, and a minor portion thereof, at an end thereof, extending normal to said latter given plane;

said principal portion of said second plate defines said platform;

said minor portion of said second plate defines part of said third means;

said minor portions of said first and second plates are in slidably, juxtapositioned and surmounting relationship;

one of said minor portions of said plates has an elongate slot formed therein;

the other of said minor portions of said plates has a plurality of apertures formed therethrough; and said apertures of said plurality thereof are aligned for registry with said slot.

2. A sighting device, according to claim 1, wherein:

one of said apertures and said slot have a fastener passed therethrough for adjustably setting said minor portions of said plates in a selected, slidable juxtapositioning which accommodates a desired azimuth sighting.

3. A sighting device, according to claim 1, wherein:

said plates, adjacent ends thereof which are opposite said minor portions thereof, have adjustable stand-off means mutually coupled thereto;

said stand-off means defining a remaining part of said third means, and comprising means cooperative with said minor portions of said plates for selectively adjusting said spaced-apart adjacency of said platform to said base to greater or less adjacency.

4. A sighting device, according to claim 1, wherein:

said fourth means comprises an elongate strip;

said platform has an aperture formed therein;

said strip has an aperture formed therein; and a fastener is passed through said platform and strip apertures pivotably to join said strip to said platform.

5. A sighting device, according to claim 1, wherein:

said second plate has an arcuate keyway formed therein; and said fourth means has means defining a key slidably engaged with said keyway.

6. A sighting device, for a bow, comprising: p1 first means defining a base;

said base having means for coupling thereof replaceably to a bow;

second means defining a platform;

third means, joined to said base and platform, supporting said platform in spaced-apart adjacency to said base;

fourth means for removably receiving sighting means thereon; and means pivotably coupling said fourth means to said platform, whereby elevation sighting adjustments may be made; and wherein said third means comprises means for selectively disposing said platform (a) in parallelism with said base, and (b) in acute angles relative to said base, whereby azimuth sighting adjustments may be made;

said fourth means comprises an elongate strip;

said platform has an aperture formed therein;

said strip has an aperture formed therein;

a fastener is passed through said platform and strip apertures pivotably to join said strip to said platform;

said strip has a threaded bore formed therethrough, normal thereto, adjacent one end thereof, and a threaded bore formed therethrough, normal thereto, adjacent the other end thereof;

an eye-bolt is replaceably threaded in one of said threaded bores; and a pin, tapered to a point at one end, and threaded at the other end, is replaceably threaded in the other of said threaded bores.

7. A sighting device, according to claim 6, wherein:

said strip, at a first one of said one ends, is of a given thickness, and is spaced apart from said platform a given distance;

said given thickness and said given distance, together, total a predetermined measurement; and said eye-bolt has a length which is less than said measurement, whereby said eye-bolt is engageable with said other threaded bore for projection from said platform for sighting purposes, and is threadedly engageable with said other threaded bore for projection toward said platform for stowage purposes without inhibiting pivotable movement of said strip and without protruding externally from said strip.

8. A sighting device, for a bow, comprising:

first means defining a base;

said base having means for coupling thereof replaceably to a bow;

second means defining a platform;

third means, joined to said base and platform, supporting said platform in space-apart adjacency to said base;

fourth means for removably receiving sighting means thereon; and means pivotably coupling said fourth means to said platform, whereby elevation sighting adjustments may be made; and wherein said third means comprises means for selectively disposing said platform (a) in parallelism with said base, and (b) in acute angles relative to said base, whereby azimuth sighting adjustments may be made;

said first means comprises a first elongate plate;

said plate having a principal portion thereof subsisting in a given plane, and a minor portion thereof, at an end thereof, extending normal to said given plane;

said principal portion of said plate defining said base;

said minor portion of said plate defining part of said third means;

said second means comprises a second elongate plate;

said second plate having a principal portion thereof subsisting in a given plane, and a minor portion thereof, at an end thereof, extending normal to said latter given plane;

said principal portion of said second plate defines said platform; and said minor portion of said second plate defines part of said third means;

said second plate has an arcuate keyway formed therein;

said fourth means has means defining a key slidably engaged with said keyway;

said keyway comprises an arcuate slot formed through said platform;

said fourth means comprises an elongate strip; and said key comprises a bolt extending normal from said strip and in traverse of said slot.

9. A sighting device, according to claim 8, wherein:

said strip has means formed on lateral edges thereof defining trackways for ancillary sighting components, such as boresights, telescopes, and the like.

10. A sighting device, according to claim 9, wherein:

said trackways comprise shoulders extending along said lateral edges and substantially the full lengths thereof.

* * * * *